US006148727A

United States Patent [19]

Parthasarathy et al.

[11] Patent Number: 6,148,727

[45] Date of Patent: Nov. 21, 2000

[54] WET PRINTED MEDIA OUTPUT MANAGEMENT SYSTEM

[75] Inventors: Baskar Parthasarathy; Sathiyamoorthy T. Sivanandam; Danny Lian Hock Ng, all of Singapore, Singapore

[73] Assignee: Hewlett-Packard Company, Palo Alto, Calif.

[21] Appl. No.: 09/183,736

[22] Filed: Oct. 30, 1998

[30] Foreign Application Priority Data

Dec. 31, 1998 [SG] Singapore ..... 9800218

[51] Int. Cl.[7] ..... B41F 1/00

[52] U.S. Cl. ..... 101/417; 101/419; 271/189; 347/102

[58] Field of Search ..... 101/416.1, 417, 101/419; 271/189; 347/101, 102

[56] References Cited

U.S. PATENT DOCUMENTS

| | | | |
|---|---|---|---|
| 1,054,987 | 3/1913 | Reid et al. | 101/419 |
| 1,403,371 | 1/1922 | Appleby | 101/419 |
| 1,420,653 | 6/1922 | Gilbert et al. | 101/417 |
| 2,329,857 | 9/1943 | Sammons | 101/416.1 |
| 2,386,029 | 10/1945 | Zuckerman | 101/416.1 |
| 5,791,247 | 8/1998 | Kolb | 101/416.1 |

*Primary Examiner*—Eugene Eickholt

[57] ABSTRACT

A printer having a system to manage the output path of wet printed media is disclosed. In such a system, the wet printed media are held for a time before being ejected into an output tray to avoid the smearing of the wet print markings made on the media. The system achieves this holding time by causing the wet printed media to travel an additional distance over movable ramps before being ejected. In addition, the movements of the ramps are synchronized with the various operations in the printing cycle of the printer.

16 Claims, 7 Drawing Sheets

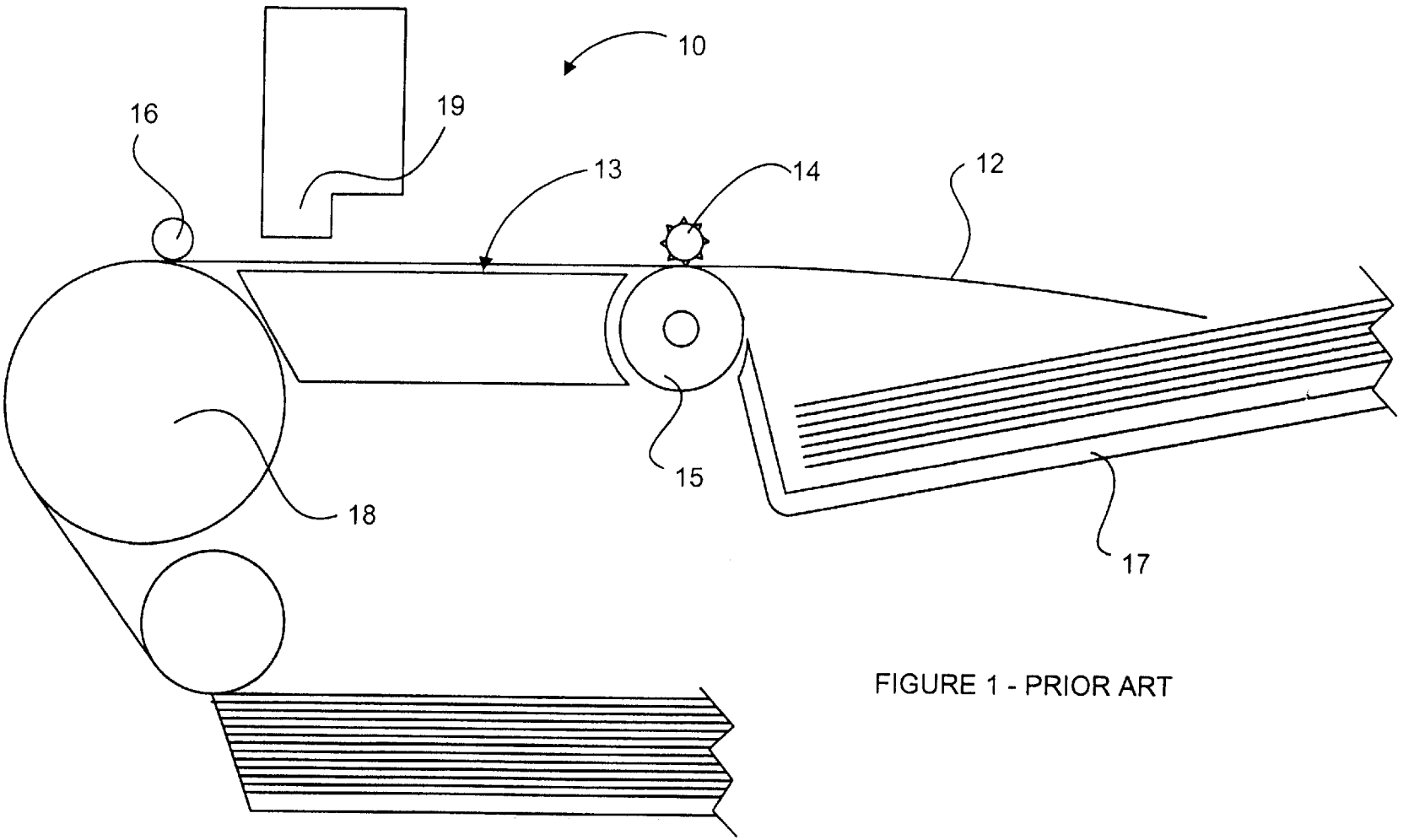
FIGURE 1 - PRIOR ART

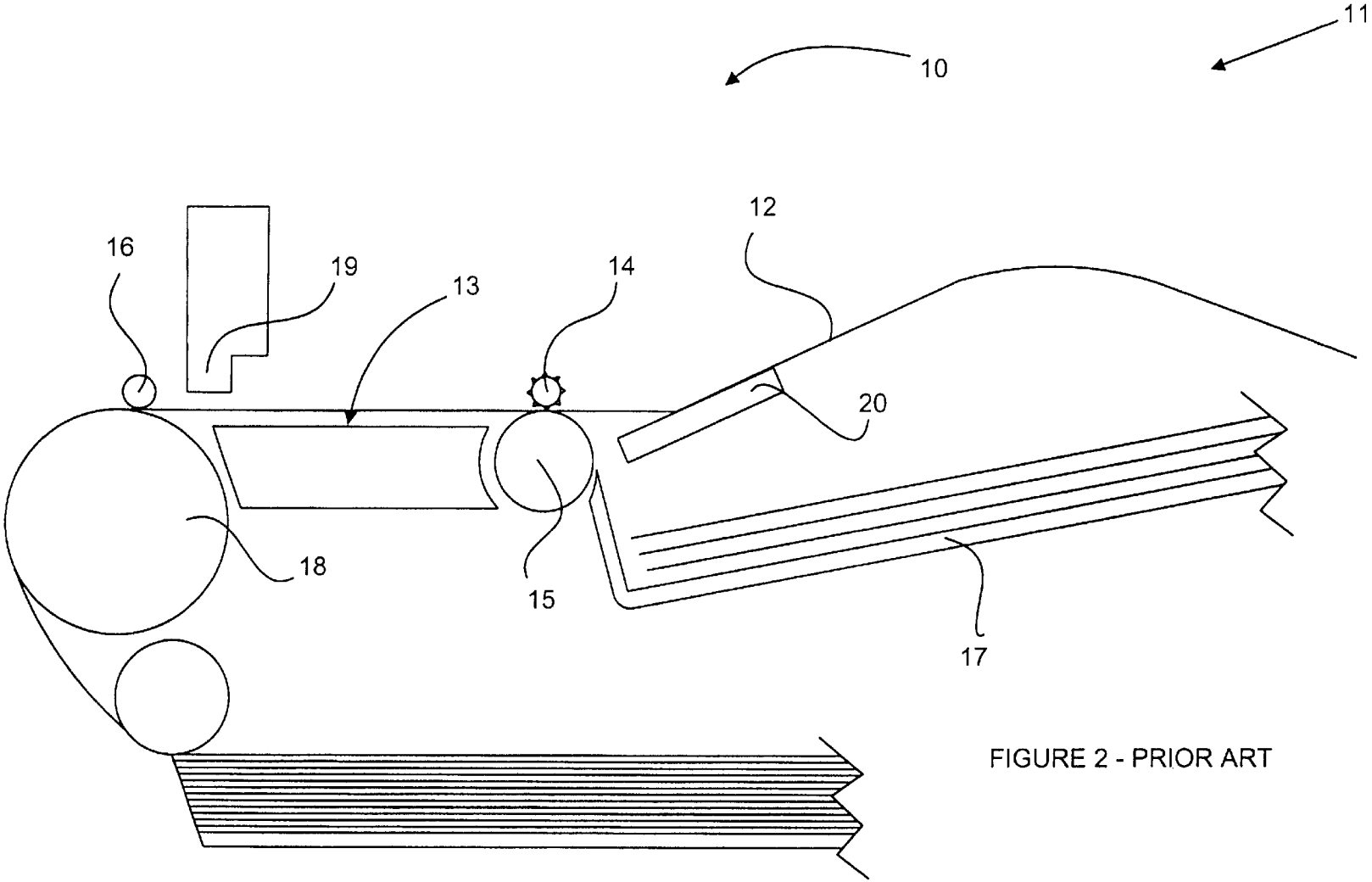
FIGURE 2 - PRIOR ART

WET PRINTED MEDIA OUTPUT MANAGEMENT SYSTEM

FIELD OF INVENTION

The invention relates generally to the management of media in a printing device. In particular, it relates to a system for managing wet printed media output in a printing device.

BACKGROUND OF THE INVENTION

Nowadays, users of home or office printers often work with media of sizes ranging from postcards to wide formats like B-size. These media are also available in different thicknesses. To remain competitive, therefore, manufacturers of printers must design their products to handle a wide range of media of different sizes and thicknesses. In addition, these printers must be able to provide high throughput to meet the needs of the more sophisticated and throughput-oriented users. Hence, these printers would require an efficient media output management system in order to be able to satisfy such user needs. This requirement is especially true for printers meant for use in a multi-user network environment.

A simplified side view of a typical wet printed media output management system 10 in an inkjet printer 11 is shown in FIG. 1. As illustrated, a wet printed medium 12 travels over a media support surface, or platen 13, during wet printing in the direction as shown by an arrow A. An ejection mechanism comprising a series of starwheels 14 working together, or cooperating, with a series of output rollers 15 is used to handle the wet printed medium 12 together with a drive mechanism. The drive mechanism is made up of a series of outpinch rollers 16 cooperating with a series of drive rollers 18.

The ejection mechanism performs two essential functions. Firstly, the ejection mechanism pulls on and ejects the wet printed medium 12 once the rear edge of the wet printed medium 12 leaves the outpinch rollers 16. This pulling action is provided by the rotating output rollers 15 which are in frictional contact with the wet printed medium 12. The starwheels 14, in pushing the wet printed medium 12 against the output rollers 15 to provide such a frictional contact, lightly bite into the surface of the wet printed medium 12. The ejection mechanism subsequently ejects and thereby stacks the wet printed medium 12 in an output tray 17. Up until the point when the rear edge of the wet printed medium 12 leaves the outpinch rollers 16, the wet printed medium 12 is carried forward, or caused to advance, over the platen 13 by both the ejection mechanism and the drive mechanism.

Secondly, the ejection mechanism cooperates with the drive mechanism to form a tension, or stretching force, on a portion of the wet printed medium 12 to cause that portion to flatten out. The flatness of the portion of the wet printed medium 12 in turn has an effect on the space between its surface and a pen nozzle 19 which provides the wet print markings, thus affecting the print quality of the wet print markings.

Variations to the typical wet printed media output management system described in the foregoing have been proposed for various reasons. For example, in order to avoid smearing the wet print markings of any previously prepared printed medium, the wet printed medium 12 has to be held for some time before it is placed in the output tray 17. By isolating the wet printed medium 12 from a printed media stack in the output tray 17, or holding the wet printed medium 12, more time is allocated to the wet print markings to dry. This holding time is achieved by forcing the wet printed medium 12 to travel a longer distance, known as holding distance, before it can be placed in the output tray 17. Thus, a series of spaced-apart holding members, or "ramps" 20, are used to hold the printed medium 12 for a predetermined holding distance, as shown in FIG. 2. For such an arrangement, ramp parameters such as the ramp angle and the ramp length are important. In general, steeper and longer ramps 20 will provide an improved holding time.

While such wet printed media output management systems have achieved commercial implementation, they suffer from disadvantages. A disadvantage addressed by the present invention is that with the improved holding time, the resistance provided by the ramps 20 against the advancing wet printed medium 12 also inadvertently increases. Generally, if an increase in the throughput of the inkjet printer 11 is desired, a corresponding longer holding time is required. This longer holding time is necessary because the speed with which the wet printed medium 12 is ejected is high, and therefore the possibility of smearing also increases. However, increasing the angles and lengths of the ramps 20 increases not only the holding time, but also the resistance presented by the ramp 20 against the advancing wet printed medium 12. This ramp resistance commonly exists in two different operations that are part of the printing cycle. During a printing operation which is one of the operations, the ejection mechanism cooperates with the drive mechanism to advance the wet printed medium 12 over the platen 13 and cause a portion of the wet printed medium 12 to flatten out during printing. Therefore, the combined force provided by the cooperating mechanisms in advancing the wet printed medium 12 overcomes the ramp resistance experienced by the wet printed medium 12 during this operation. In contrast, the ramp resistance experienced during an ejection operation, the other operation in the printing cycle in which the ejection mechanism ejects the wet printed medium 12, is overcome solely by the force provided by the ejection mechanism. As a prerequisite therefore, the starwheels 14 need to be activated by larger spring forces. Such larger spring forces will, however, cause the starwheels 14 to leave visible bite marks on the wet printed medium 12. In the instance of a user who is preparing presentation slides using the inkjet printer 11 employing the starwheels 14 activated by such larger spring forces, such bite marks are unacceptable.

The presence of steeper and longer ramps 20 in the inkjet printer 11 also increases the undesirable bending of thick media like postcards, envelopes, Norman media or photography media. In order to overcome this bending problem, the ramps 20 are usually designed to be adjustable to a flat, or horizontal, position by a manually operated lever (not shown). This arrangement is quite useful in alleviating the bending problem when the inkjet printer 11 is used as a standalone printer. However, in a multi-user network environment where many users usually share the inkjet printer 11, the same arrangement may not be feasible at all. In such a situation, additional coordination will be required to manually adjust the ramps 20 to the correct positions for printing on different types of media.

Accordingly, it is an object of the present invention to provide a system for managing wet printed media output in a printing device capable of handling multiple media sizes and thicknesses in a multi-user network environment.

SUMMARY OF THE INVENTION

A printer capable of handling media of different sizes and thicknesses in a multi-user network environment is provided with a system to manage the output path of wet printed media. Such a system uses a drive mechanism and an ejection mechanism to handle the media during printing. During a printing operation, the mechanisms cooperate to advance a medium and cause the medium to flatten out while it receives print markings. In an ejection operation, the ejection mechanism independently advances and ejects the printed medium. Additionally, at least one holding member is connected to the printer that automatically moves between a first position and a second position. The holding member is able to engage in the first position during the printing operation to hold the printed medium. Subsequently, the holding member is moves to the second position during the ejection operation to enable the printed medium to be ejected. For proper operation, the movement of the holding member is synchronized with the two operations.

In a preferred embodiment of the invention, a controller is used to synchronize the automated movement of a series of holding members. Each holding member moves by extending outwardly from the printer into the first position, and retracts into the second position to allow gravitational forces to urge a printed medium to eject. In addition, each holding member is inclined when it is in the first position. Moreover, each holding member is profiled to bow the printed medium along the direction that the printed medium advances.

BRIEF DESCRIPTION OF THE DRAWINGS

The invention will be better understood with reference to the drawings, in which:

FIG. 1 shows a simplified side view of an inkjet printer provided with a prior art wet printed media output management system;

FIG. 2 shows a variation of the prior art wet printed media output management system in FIG. 1 additionally provided with a ramp;

DESCRIPTION OF THE PREFERRED EMBODIMENT

Figure 3A:
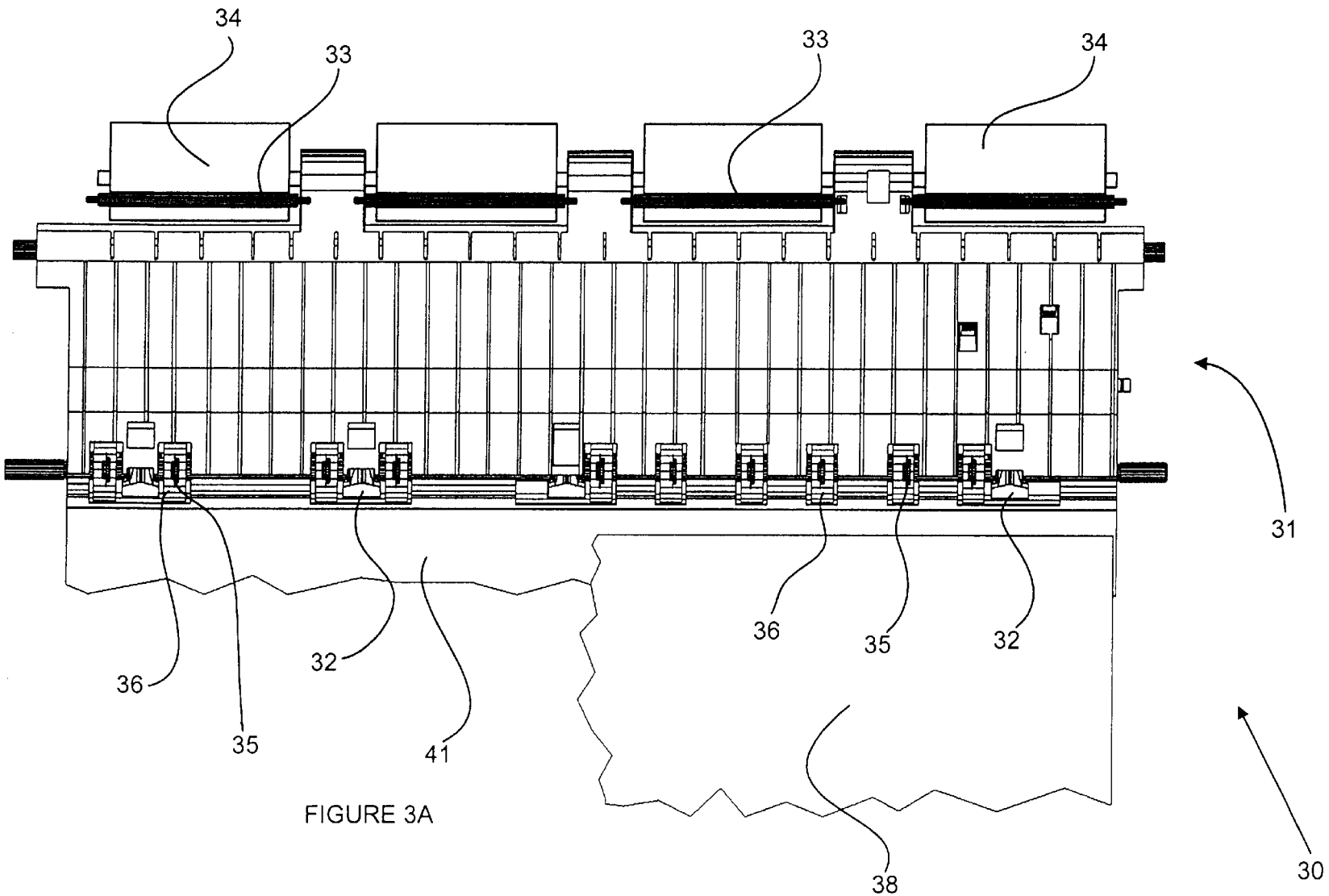
FIG. 3A shows a top view of a wet printed media output management system in an inkjet printer according to a preferred embodiment of the invention.
Figure 3B:
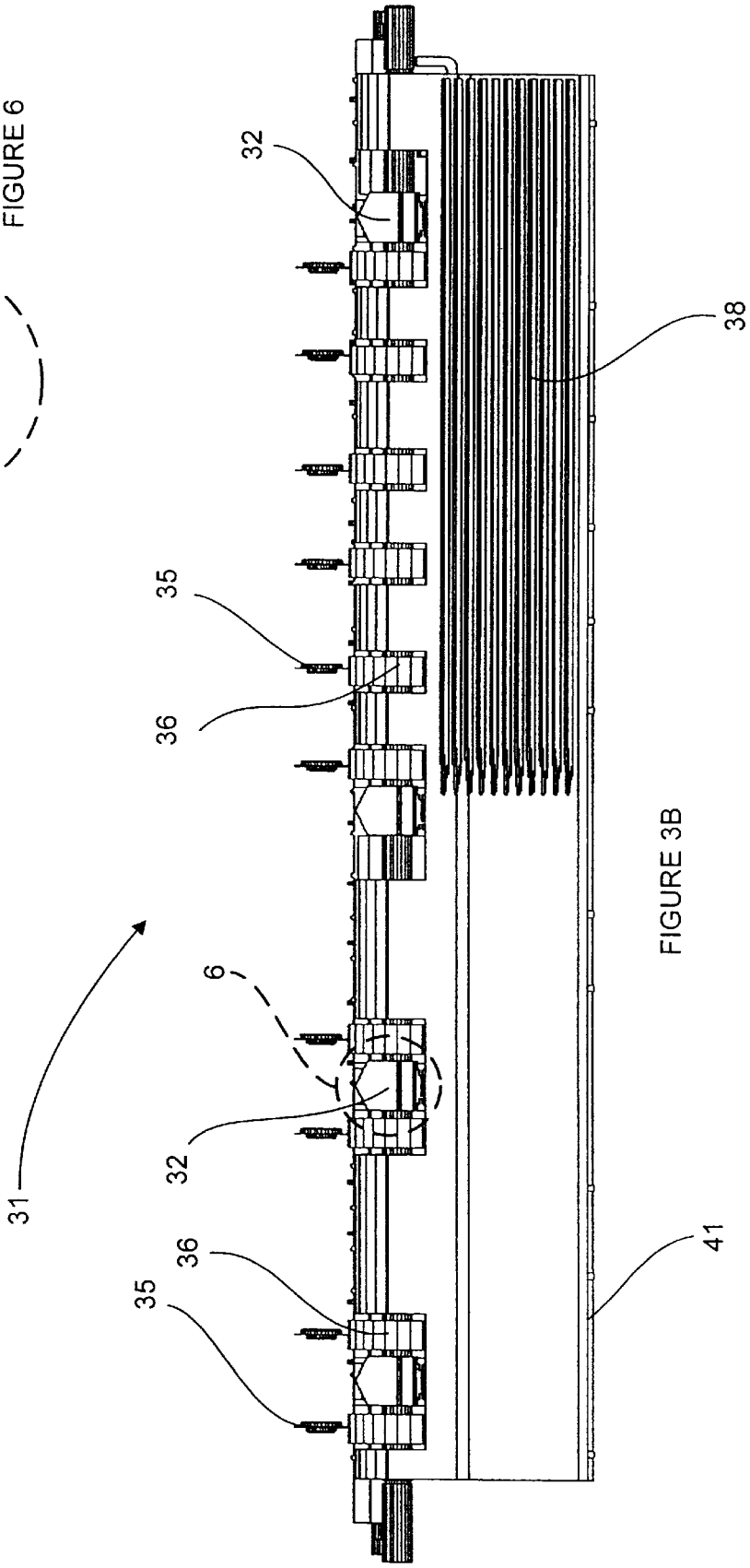
FIG. 3B shows a front view of the wet printed media output management system in FIG. 3A.
Figure 3C:
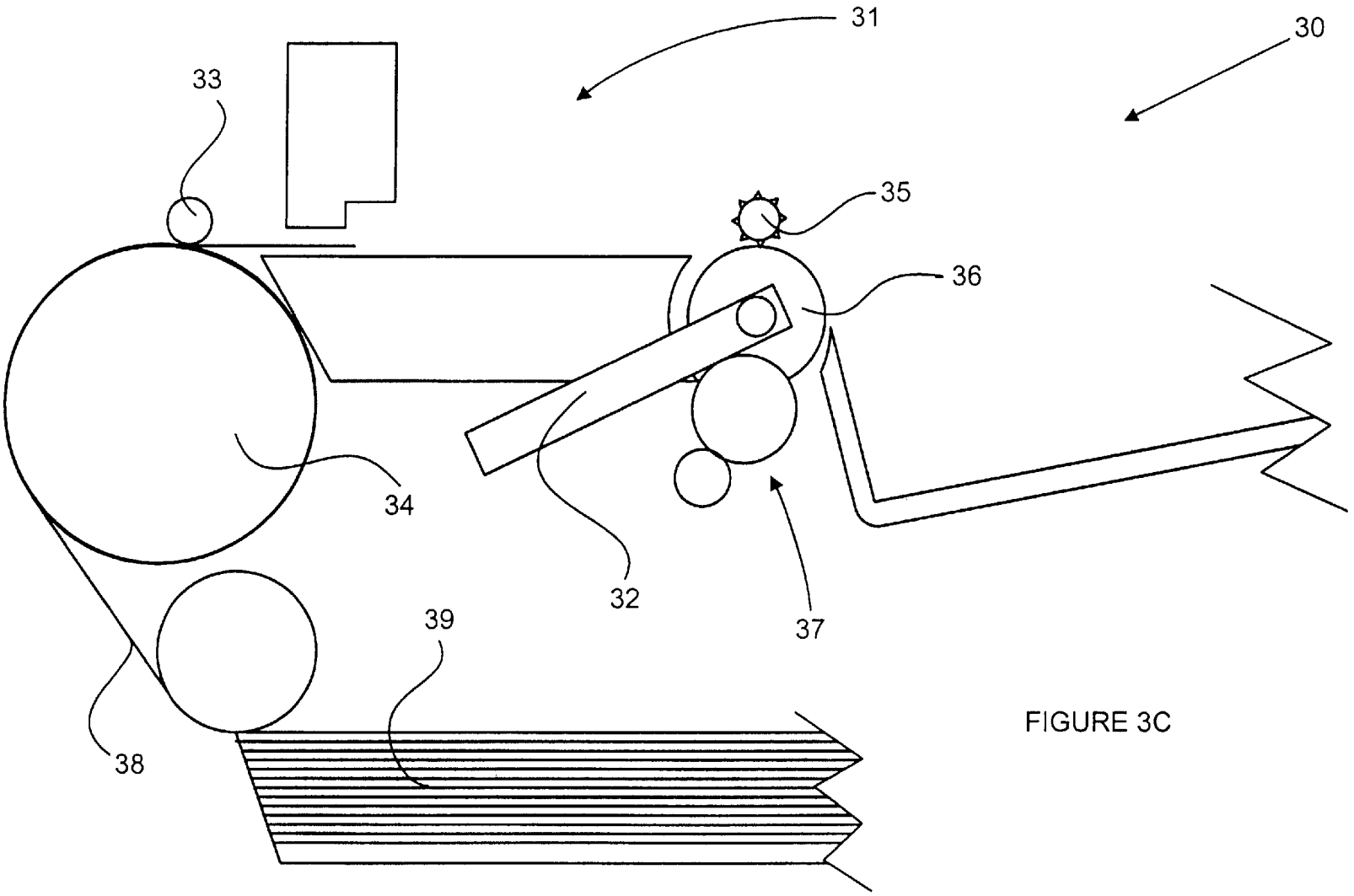
FIG. 3C shows a simplified side view of the wet printed media output management system in FIG. 3A during a pick operation.

Reference is first made to FIG. 3A, FIG. 3B and FIG. 3C to describe an inkjet printer 30 which is provided with a wet printed media output management system 31 according to a preferred embodiment of the invention. The wet printed output management system 31 is made up of a drive mechanism, an ejection mechanism and preferably a series of retractable ramps 32. The drive mechanism preferably operates through a series of outpinch rollers 33 and drive rollers 34 cooperating with each other. Similarly, a series of starwheels 35 and output rollers 36 are cooperatively configured to preferably form the ejection mechanism. In addition, the movements of the retractable ramps 32 are preferably automated by a gear train 37 (shown in FIG. 3C only) which is powered by a motor (not shown at all).

As illustrated in FIG. 3C, the home positions of the retractable ramps 32 are located behind and below the output rollers 36. During a pick operation, a medium 38 is picked from a media stack 39. When the front edge of the medium 38 reaches the outpinch rollers 33, a controller, preferably a firmware controller (not shown), will direct the retractable ramps 32 to move by activating the gear train 37. The retractable ramps 32 will then extend to their upper-most positions before the front edge of the medium 38 reaches the starwheels 35.

Figure 4:
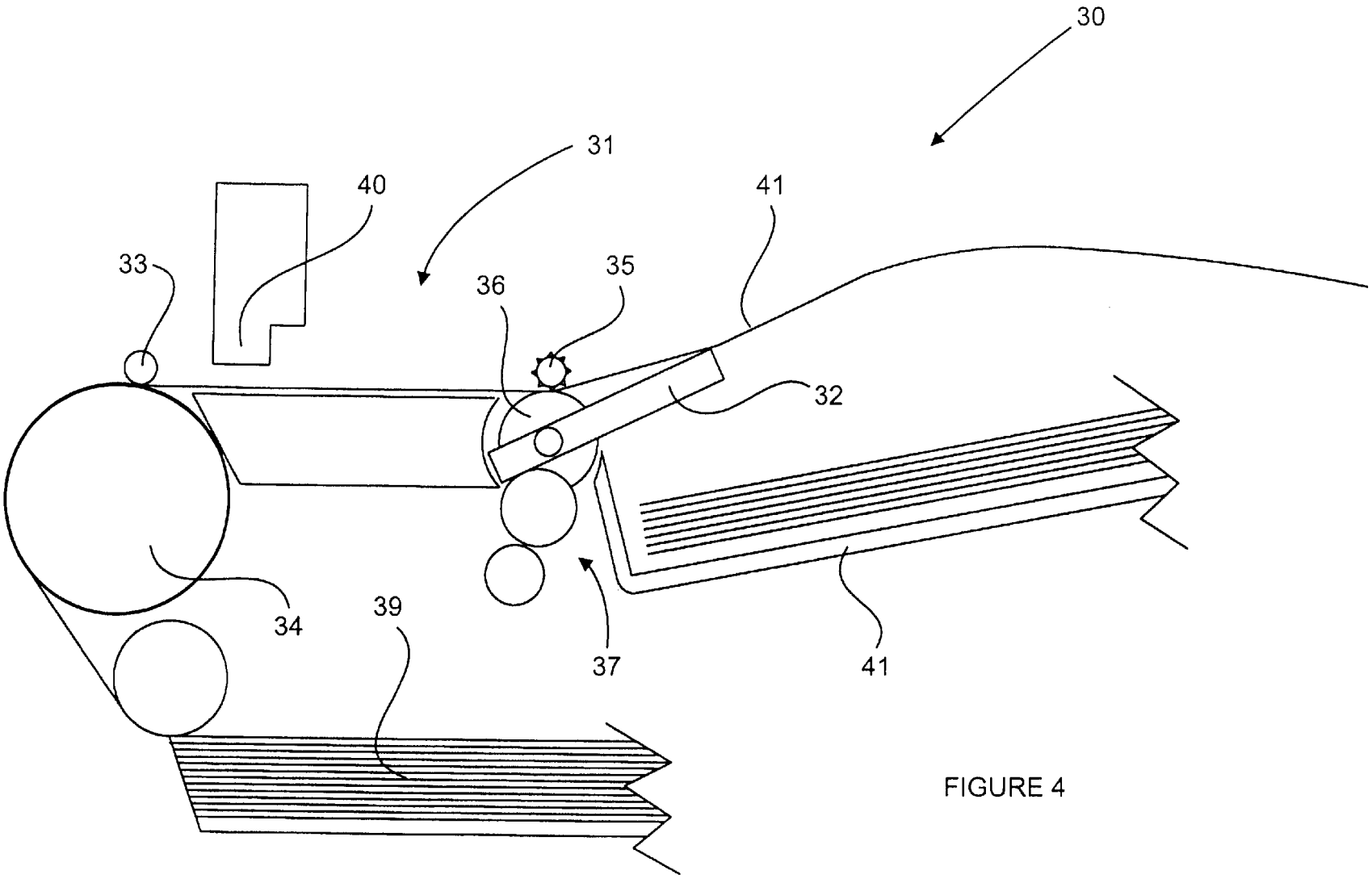
FIG. 4 shows the simplified side view of the wet printed media output management system in FIG. 3A during a printing operation.

During a printing operation as shown in FIG. 4, a pen 40 will make wet print markings on the surface of medium 38 while the drive mechanism advances and positions the medium 38 for printing. When the front edge of the now wet printed medium 38 reaches the starwheels 35, the ejection mechanism will start pulling the wet printed medium 38 forward. In doing so, the ejection mechanism cooperates with the drive mechanism to provide a stretching force to cause the portion of the wet printed medium 38 disposed between the two mechanisms to flatten out.

Subsequently, the front edge of the wet printed medium 38 advances past the starwheels 35, with the help of the drive and ejection mechanisms. To allocate sufficient time for the wet print markings to dry, the wet printed medium 38 is then made to travel a holding distance before being dropped into an output tray 41. The retractable ramps 32 provide this holding distance and are therefore able to hold the wet printed medium 38 during the printing operation, as shown in FIG. 4. The wet printed medium 38, while moving over the surface of the retractable ramps 32, will experience resistance from the retractable ramps 32 because they are inclined. However, this ramp resistance is small when compared to the combined force provided by the cooperating drive and ejection mechanisms that advance the wet printed medium 38.

Figure 5:
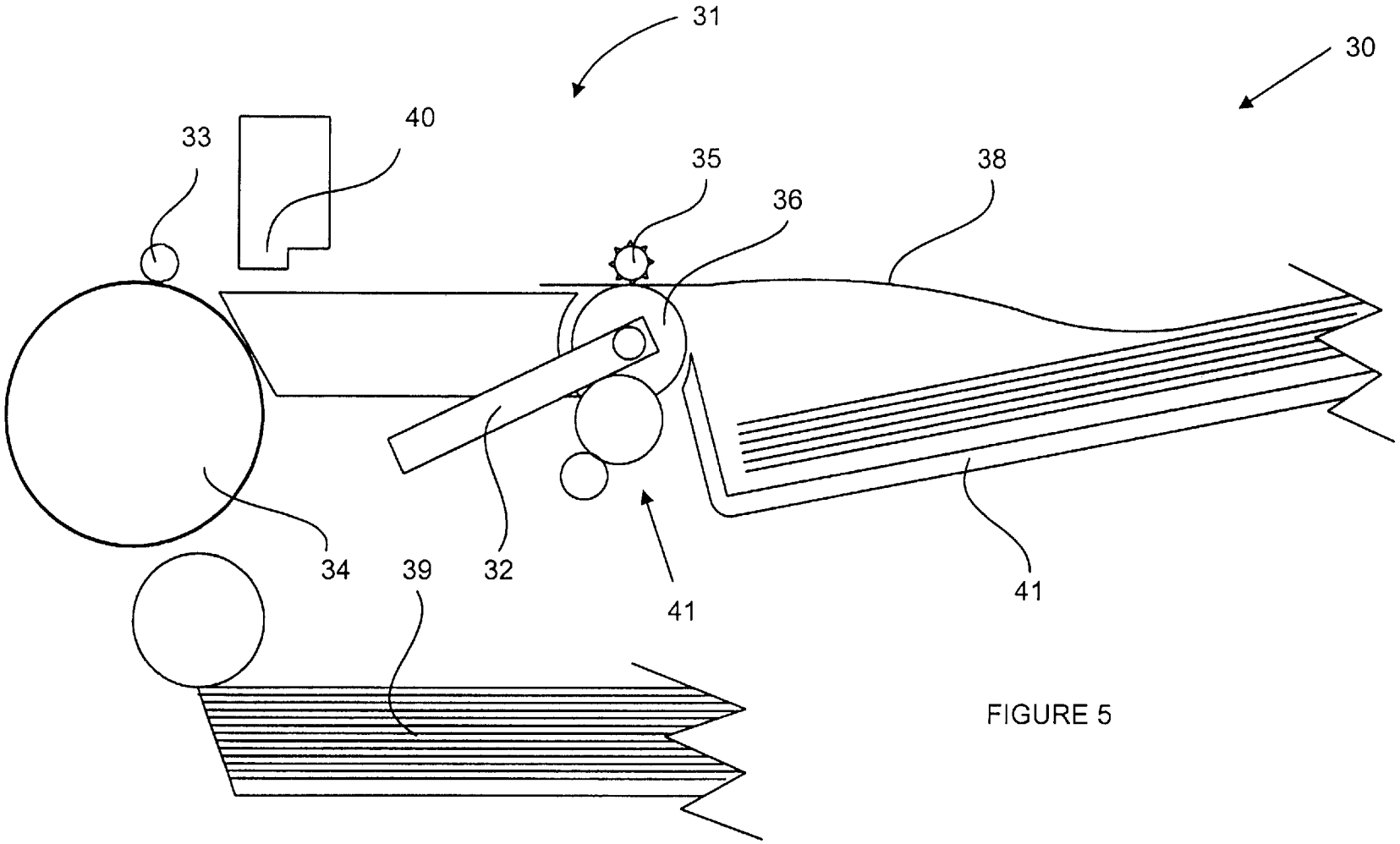
FIG. 5 shows the simplified side view of the wet printed media output management system in FIG. 3A during an ejection operation.

An ejection operation begins when the rear edge of the wet printed medium 38 leaves the outpinch rollers 33 as shown in FIG. 5. During this operation, the ramp resistance can become a problem, especially since the ramp resistance is considerable when compared to the pulling force provided by the ejection mechanism. To overcome this problem, the firmware controller will direct the retractable ramps 32 to retract immediately once the rear edge of the wet printed medium 38 reaches the outpinch rollers 33. With the retractable ramps 32 down, the starwheels 35 can then advance the wet printed medium 38 without being impeded by any ramp resistance. The wet printed medium 38 is subsequently ejected and caused to drop into the output tray 41 by gravitational forces.

Figure 6:
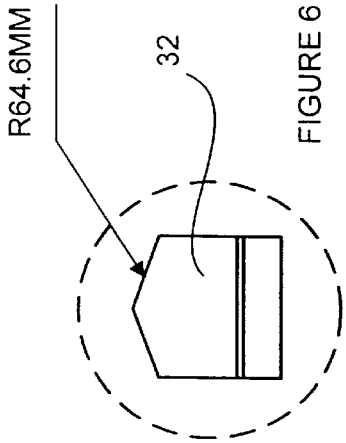
FIG. 6 shows an enlarged front view of a retractable ramp employed in the wet printed media output management system in FIG. 3B.

Each of the retractable ramps 32 is shaped to have a profile, as shown in FIG. 6, that encourages the bowing of the wet printed medium 38 along the direction that the printed medium 38 advances. By making the wet printed medium 38 bow in such a way, the holding time may be improved.

The firmware controller in the foregoing is able to synchronize the movements and engagements of the retractable ramps 32 in various positions because of information provided by a software driver for the inkjet printer 30. This software driver provides the firmware controller with the information on the type of media that are receiving print markings.

Similarly, the firmware controller is informed when the printer handles thick media. To avoid the undesirable bending of thick media, the retractable ramps 32 will not be extended during the corresponding printing operation. The reason is that thick media are stiff and are therefore able to hold their own weight for a sufficient distance without the use of the retractable ramps 32 before they drop into the output tray 41.

The preferred embodiment can be modified in many ways. For example, the holding members may be incrementally angled to reduce the ramp resistance. In another example, the holding members may be automatically brought to intermediate positions which are horizontal for providing further holding time and reduced ramp resistance during the ejection operation before being retracted. The holding members may also be automatically brought to horizontal positions during the printing operation of thick media to provide more holding time and yet avoid the thick media bending problem. In yet another example, the holding members may move to the various positions by rotating about axes that are orthogonal to the direction of the advancing media. Such holding members may be automated to swing about in the vertical plane from home positions to ramp positions. Alternatively, these holding members may be automated to swing about in the horizontal plane from home positions to ramp positions. In still another example, a single holding member substantially spanning the width of the inkjet printer may be used in place of the series of holding members.

The present invention of a wet printed media output management system having synchronized automated ramps provides an inkjet printer designer the freedom to design the angle and length of the ramps. Hence, steeper and longer ramps can be used to increase the holding distance without impeding the ejection operation so that starwheels bite marks may be avoided. Smearing of print markings on the printed media is also reduced because extended drying time is provided. In addition, no manual intervention is required to take care of different media of different sizes and thicknesses. Therefore, an inkjet printer having such a wet printed media output management system could be suitably used in a multi-user network environment.

We claim:

1. An apparatus for managing wet printed media output in a printer capable of handling multiple media sizes and thicknesses in a multi-user network environment, comprising:

a drive mechanism for positioning a medium in the printer to receive wet print markings;

an ejection mechanism operating cooperatively with the drive mechanism for causing the medium to flatten out during wet print marking in a printing operation, and independently for ejecting the wet printed medium in an ejection operation; and an automated holding member movably connected to the printer so that the automated engagement of the holding member in a first position is synchronized with the printing operation for providing a selected holding distance to hold the wet printed medium advancing past the ejection mechanism, and the automated engagement in a second position is synchronized with the ejection operation for the ejection of the wet printed medium.

2. The apparatus as in claim 1, further comprising a controller for synchronizing the automated engagement of the holding member in the first position with the printing operation, and in the second position with the ejection position.

3. The apparatus as in claim 2, wherein the holding member provides a ramp along the wet printed media output path in the first position for providing a holding distance to hold the wet printed media.

4. The apparatus as in claim 3, wherein the ramp is gradually increasingly angled for reducing ramp resistance.

5. The apparatus as in claim 2, wherein the automated engagement of the holding member in a further intermediate position is synchronized with the ejection operation, before engaging in the second position, for further holding the wet printed media.

6. The apparatus as in claim 5, wherein the holding member provides a substantially horizontal surface along the wet printed media output path in the intermediate position.

7. The apparatus as in claim 2, further comprising:

a gear train for automating the movement of the holding member; and a motor in engagement with the gear train and actuable by the controller for rotatably driving the gear train.

8. The apparatus as in claim 7, wherein the holding member engages in the first position by extending from the printing device.

9. The apparatus as in claim 8, wherein the holding member is retracted in the second position to allow the gravitational force on the wet printed media to urge the ejection.

10. The apparatus as in claim 1, wherein the holding member provides a predefined surface to urge the wet printed media to bow along the direction of the wet printed media output path.

11. The apparatus as in claim 1, wherein the drive mechanism comprises:

a plurality of rotatably driven drive rollers; and a plurality of outpinch rollers operating cooperatively with the plurality of drive rollers for positioning the media in the printer to receive wet print markings.

12. The apparatus as in claim 11, wherein the ejection mechanism comprises:

a plurality of rotatably driven output rollers; and a plurality of starwheels operating cooperatively with the plurality of output rollers for advancing the media.

13. A method for managing wet printed media output in a printer capable of handling multiple media sizes and thicknesses in a multi-user network environment, the printer having a drive mechanism, an ejection mechanism and an holding member, comprising the steps of:

advancing a wet printed medium, by cooperatively operating the drive mechanism and the ejection mechanism in a printing operation when the media receives wet print markings;

ejecting the wet printed medium by using the ejection mechanism in an ejection operation;

automating the movement of the holding member;

engaging the holding member in a first position synchronized with the printing operation for providing a selected holding distance to hold the wet printed medium advancing past the ejection mechanism; and engaging the holding member in a second position synchronized with the ejection operation for ejecting the wet printed medium.

14. The method as in claim 13, wherein the steps of engaging the holding member in the first and second positions further include using a controller for synchronizing the engagements of the holding member in the first and second position with the printing and ejection operations respectively.

15. The method as in claim 13, wherein the steps of engaging the holding member in the first and second positions include using a gear train rotatably driven by a motor.

16. The method as in claim 15, wherein the steps of engaging the holding member in the first and second positions using the gear train includes extending and retracting the holding member respectively.

* * * * *